US005263703A

United States Patent [19]

Derrick

[11] Patent Number: 5,263,703

[45] Date of Patent: Nov. 23, 1993

[54] ORBITING NIP CONTROL FOR INCREASING SHEET STACKING CAPACITY

[75] Inventor: John F. Derrick, Williamson, N.Y.

[73] Assignee: Xerox Corporation, Stamford, Conn.

[21] Appl. No.: 979,964

[22] Filed: Nov. 23, 1992

Related U.S. Application Data

[62] Division of Ser. No. 903,298, Jun. 24, 1992, Pat. No. 5,215,298.

[51] Int. Cl.[5] ..... B65H 29/00

[52] U.S. Cl. ..... 271/186; 271/81; 271/207

[58] Field of Search ..... 271/65, 81, 186, 291, 271/300, 301, 302, 303, 304, 207

[56] References Cited

U.S. PATENT DOCUMENTS

| | | | |
|---|---|---|---|
| 4,858,909 | 8/1989 | Stemmle | 271/184 |
| 4,887,060 | 12/1989 | Kaneko | 355/323 |
| 5,031,893 | 7/1991 | Yoneda et al. | 271/65 |
| 5,152,515 | 10/1992 | Acquaviva | 271/3.1 |
| 5,183,249 | 2/1993 | Ichikawa et al. | 271/303 X |

FOREIGN PATENT DOCUMENTS 295964 12/1986 Japan .

OTHER PUBLICATIONS

Xerox Disclosure Journal, "Orbiting Hip Sheet Control Device," by John F. Derrick, vol. 17, No. 2, Mar./Apr., 1992, pp. 69-70.

*Primary Examiner*—H. Grant Skaggs
*Assistant Examiner*—Carol Lynn Druzbick

[57] ABSTRACT

Sheet stacking utilizing an orbital nip system by initially orbiting the nip with the sheet in the nip until the nip angle is aimed well up on the registration stacking wall above the stacking tray and adjacent the desired maximum stack height even if the tray is empty; feeding the sheet in this initial nip position out towards the wall at a preset nip feeding velocity without substantially orbiting the nip; then, when the edge of the sheet is within approximately 10 millimeters of the registration stacking wall, starting to orbit the nip with the sheet in the nip, away from the wall and downwardly at an orbiting angular velocity which is substantially slower (0.4 to 0.6) than the nip feeding velocity, so that the movement of the sheet into engagement with the wall is substantially faster than the orbital motion of the nip away from the wall, and causing the portion of the sheet downstream of the nip to downwardly buckle and hold the sheet edge against the wall as the remainder of the sheet is fed through the nip. Improved inverted or non-inverted stacking is provided.

5 Claims, 2 Drawing Sheets

ORBITING NIP CONTROL FOR INCREASING SHEET STACKING CAPACITY

Figure 1:
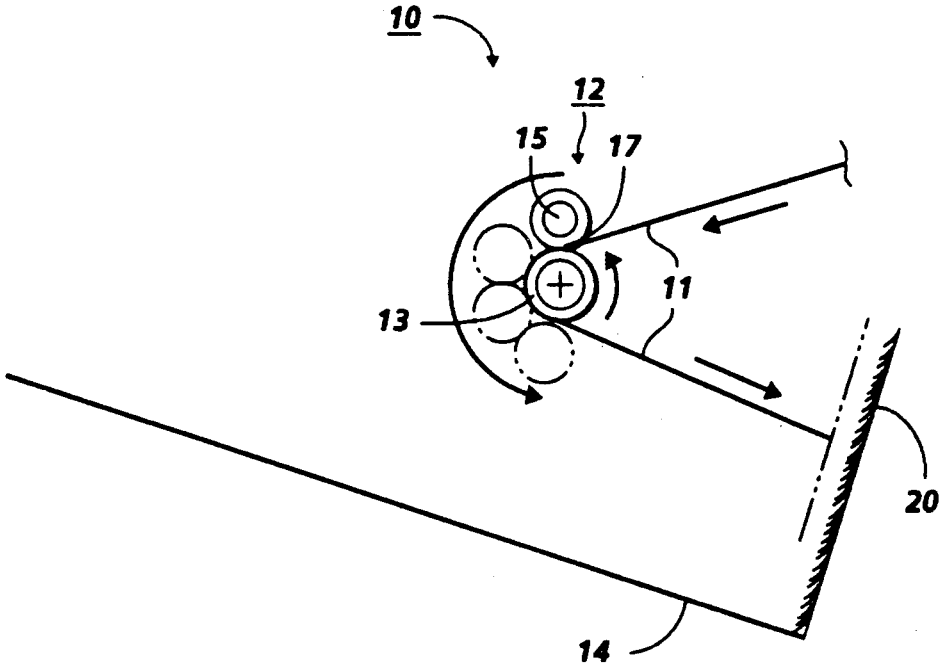

This application is a divisional of prior application Ser. No. 07/903,298, now U.S. Pat. No. 5,215,298. The method of this application was disclosed in said prior application by John F. Derrick and accordingly, this application claims priority therefrom.

Cross-reference is made to commonly assigned Xerox Corporation U.S. applications Ser. No. 07/903,298 by Denis J. Stemmle and this same John F. Derrick entitled "Orbiting Nip Sheet Output With Faceup Or Facedown Stacking and Integral Gate", filed Jun. 24, 1992; and Ser. No. 07/903,291 by Denis J. Stemmle entitled "Orbiting Nip Plural Mode Sheet Output With Faceup or Facedown Stacking", filed Jun. 24, 1992. These applications disclose improvements and novel features over the orbiting nip stacker of Xerox Corporation U.S. Pat. No. 4,858,909, issued Aug. 22, 1989 to the same Denis J. Stemmle. All three are incorporated by reference herein.

In particular, there is described by this inventor in said prior application Ser. No. 07/903,298: "If, however, as noted, one wishes to use a simple fixed position tray or bin with the disclosed orbital nip inversion, then, for that alternative, there is a suggestion of said John F. Derrick, for overcoming upward bucking or stacking registration problems with that fixed tray alternative only. [In fixed tray stacking, the distance from the nip to the backstop impact position for the lead edge of the incoming sheet will, of course, vary with the stack height.] This is to aim the lead edge of the entering sheet with the orbital nip to hit high up on the registration stacking wall (backstop), at the maximum intended stacking level for that fixed tray, even if the tray is empty, and to compensate for the tendency of the lead edge to either buckle from being overdriven against it when the tray is full, or to pull away from the registration wall as it drops (swings) down into the stacking corner from that initial level if the tray is empty, by starting the reverse orbiting of the nip when the lead edge is about 10 mm from the backstop and reverse orbiting the nip at an orbital velocity of about one-half (0.4 to 0.6) of the forward feeding movement velocity of the sheet. Thus, even if the lead edge of the sheet initially misses the stacking corner when the tray is nearly empty, it will be driven into registration because it has net forward velocity due to said reduced reverse orbiting velocity. If the stack was full, upward bucking is avoided, because of said starting of the reverse orbiting of the nip before the lead edge hits the backstop. As many as 750 sheets have been stacked in this manner in a fixed tray."

The disclosed system provides simple and improved output and stacking of a large number of flimsy sheets, such as the paper copy sheets outputted by a copier or printer, into a simple, low cost, fixed tray or bin, with registration, utilizing the desirable compact but positive nip sheet control, yet variable sheet redirection path, provided by a pivotal feeding nip timing and velocity controlled as described herein.

As also disclosed in said cross-referenced prior applications, the disclosed orbital nip sheet output control and stacking system has optional utility or application for inverted or non-inverted or multi-mode stacking of output sheets from a copier or printer into a stacker and/or finisher compiler tray, allowing collated printing and output of simplex or duplex copy sets, and/or forward or reverse page order output. Separate output trays are not required for faceup versus facedown stacking. Additionally, the same pivotal nip mechanism may be controlled to provide selection between different sheet output paths to different designations, if desired, without requiring any solenoid or other separately electrically or mechanically activated gates or deflectors. Further background as to the reasons for, and applications of, the selection of faceup versus facedown output stacking is further explained in said cross-referenced prior applications.

The *Xerox Disclosure Journal* Publication Vol. 17, No. 2, March/April 1992, p. 69–70, entitled, "Orbiting Nip Control Device", by this same John F. Derrick, is noted as showing and describing an additional optional feature for this system of one way fiber used as a sheet lead edge climbing prevention material on the stacking tray registration wall. This optional feature is also illustrated here.

It is noted that variable trajectory ejection into a restacking tray of a recirculating document handler is disclosed in commonly assigned Xerox Corporation U.S. Pat. No. 5,152,515 filed Mar. 5, 1992 and issued Oct. 6, 1992 to T. Acquaviva, commonly owned at the time of these respective inventions. There, variably tilting the ejecting sheet feeder in relation to the stack height changes the sheet impact position accordingly. That system therefor requires sensing or estimation of the changed stack height, as the stack in the tray is increased, and varying of the sheet ejection angle in accordance therewith. Also, in a recirculating document handler, the number of original document sheets being stacked only changes with different jobs, irrespective of the number of copies being made.

Other rotating nip angle systems, used for redirecting a copy sheet path, are disclosed in Japanese published Patent No. 61-295964 to Ohashi (Canon) filed 21.6.1985 as App. No. 60-136718, and U.S. Pat. No. 4,887,060 to Kaneko, (Japanese priority 1986), noted in a preliminary search for the parent application. Also, U.S. Pat. No. 5,031,893 issued Jul. 16, 1992 to E. Yoneda, et al., cited by the examiner in the parent application.

The searcher indicated that said U.S. Pat. No. 4,887,060 to Kaneko discloses, inter alia, a sheet discharge device having a movable member 110 comprising two pairs of rollers, i.e., first rollers 106 and second rollers 107, which are in pressure contact with each other (column 8, line 53–55). First rollers 106 are driven by a sheet carry motor 116, and second rollers 107 rotate freely (see especially FIG. 10). With the lead edge of a sheet pinched between the rollers 106 and 107, the second rollers 107 can redirect the direction of travel of the sheet by being epicyclically driven by motor 124 (see, e.g., FIG. 9) around the first rollers 106 (see especially, FIGS. 10, 11, 12 and 14). In the embodiment shown in FIG. 13, the rollers 106 and 107 are used to selectively discharge sheets to either a first paper discharge tray 208 (on the side of the device) during a continuous copy mode or a second discharge tray 209 (on top of the device) during an interrupt copying operation (column 11, line 1–70 and column 12, line 1–16).

Said Japanese published Patent No. 61-295964 (abstract) to Ohashi discloses a system having a feed roller 46, and two secondary rollers 47*a* and 47*b* which are movable by a solenoid between two portions with the top of the circumference of the feed roller 46. In a first position, the secondary feed rollers direct a sheet to an exit route 39, and in a second position, the secondary rollers redirect a sheet to a return route 40 for duplex copying. See FIGS. 1 and 3.

Further by way of background, in the prior art, outputted sheets are often effectively flown or thrown into the tray from one end thereof. That is, normal output stacking is by ejecting sheets high above one end of the top sheet of a stack of sheets onto which that ejected sheet must stack. Typically, each ejected sheet travels generally horizontally and planarly, primarily by inertia. That is, the sheet is not typically effectively controlled or guided once it is released into the open stacking tray area, and must fall by gravity into the tray to settle onto the top of the stack, which is resisted by the high air resistance of the sheet in that direction. Yet, in a high speed copier or other imager, sheet stacking must be done at high speed. Thus, a significant disadvantage of that type of stacking is that light-weight sheets of paper, in particular, have a relatively long settling time. The dropping or settling of a generally horizontal sheet is resisted by its large air resistance if it is being urged down onto the top of the stack only by its relatively very small gravitational force.

Further by way of background, the stacking of sheets is made more difficult where there are variations in thickness, material, weight and condition (such as curls), in the sheets. Different sizes or types of sheets, such as tabbed or cover sheets or inserts, may even be intermixed in the same copy sets in some cases.

Various general problems of sheet restacking, especially the settling of an ejected sheet onto the top of the stack, are well known in the art in general. Some examples of various output restacking assisting devices are taught in Xerox Corporation U.S. Pat. Nos. 5,005,821; 5,014,976; 5,014,977; 5,033,731; and art therein. Such art includes document restacking in a recirculating document handler (RDH). One approach to improving control over RDH tray document restacking is shown in Xerox Corporation U.S. Pat. No. 4,469,319, issued Sep. 4, 1984 to F. J. Robb, et al.. It teaches variable corrugation of the sheets, which corrugation is increased as the sheet ejection rollers and associated baffles are moved back horizontally with the rear wall of the tray to accommodate larger dimension sheets in the tray. That patent also teaches flexible sheet deflecting or knockdown flaps 100, 101, 102 at the sheet ejection position. U.S. Pat. No. 5,076,558, issued Dec. 31, 1991 to M. J. Bergeron, et al., also utilizes such flexible deflecting flaps (142), plus air pressure somehow directed at the ejected sheets (141). Xerox Corporation U.S. Pat. No. 4,436,301 to M. S. Doery, et al., further discusses restacking difficulties and has an overstack vacuum transport and mechanical bail lead edge knockdown system. However, such sheet "knock down" systems tend to undesirably deflect down prematurely the lead edge of the ejected sheet. Also, such "knock down" systems can interfere with sheet stack removal or loading and can be damaged thereby. Stacking control systems desirably should not interfere with open operator access to an output stacking tray or bin.

In particular, for stacking sheets the sheet ejection trajectory has to accommodate variations in the preexisting height of the stack of sheets already in the tray (varying with the set size and sheet thickness) unless a tray elevator is provided, which adds expense and potential reliability problems for the tray elevator mechanism and its controls. The trajectory should also accommodate the varying aerodynamic characteristics of a rapidly moving sheet, which can act as an airfoil to affect the rise or fall of the lead edge of the sheet as it is ejected. This airfoil effect can be strongly affected by fuser or other curls induced in the sheet. Thus, typically, a relatively high restacking ejection upward trajectory angle must be provided. Otherwise, the lead edge of the entering document can catch or stub on the top of the sheet stack already in the restacking tray, and curl over, causing a serious jam condition. [Further discussion of such restacking problems, and others, even in an RDH, is provided, for example, in U.S. Pat. No. 4,480,824, issued Nov. 6, 1984, on a document tray jam detection system.] However, setting a sufficiently high document trajectory angle to accommodate all these restacking problems normally greatly increases the sheet settling time for all sheets, as previously noted, and creates other potential problems.

As to specific hardware components which may be used with the subject apparatus, or alternatives, it will be appreciated that, as is normally the case, various such specific hardware components are known per se in other apparatus or applications, including the cited applications and patents.

The disclosed apparatus may be readily operated and controlled in a conventional manner with conventional control systems. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commerical copiers. Such software may, of course, vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. The controller signals may conventionally actuate various conventional electrical solenoid or cam-controlled deflector fingers, motors or clutches in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for various functions, and need not be described herein.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims, and in the above cross-referenced prior applications, and their drawing figures. Thus the present invention will be better understood from this description of one embodiment thereof, including the drawing figures (approximately to scale) wherein:

FIGS. 1 through 4 illustrate respective exemplary steps in a common schematic front view of one exemplary copy sheet output system incorporating one example of the present orbital nip sheet output control stacking system with an exemplary simple fixed stacking tray.

Further details of suitable exemplary hardware and controls which may be used to practice this disclosed exemplary method are already disclosed in the above-cited U.S. Ser. Nos. 07/903,298 and 07/903,291 and U.S. 4,858,909, and thus need not be redescribed herein. [Likewise, as to various additional applications and functions thereof, as noted above.] Thus, for clarity, simplified schematic views are provided here to help illustrate this disclosed improved stacking system.

Figure 2:
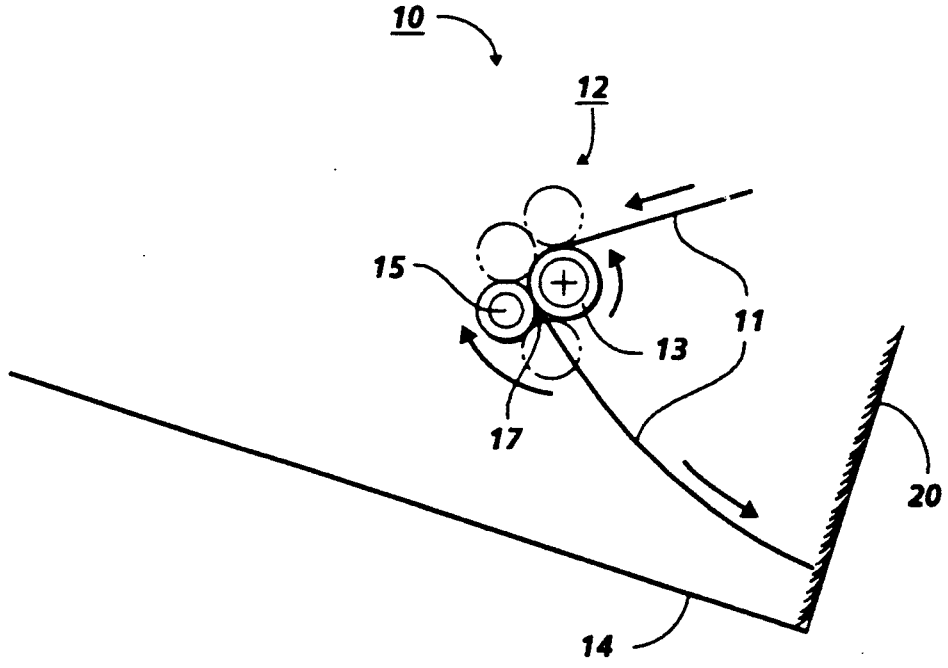
Figure 3:
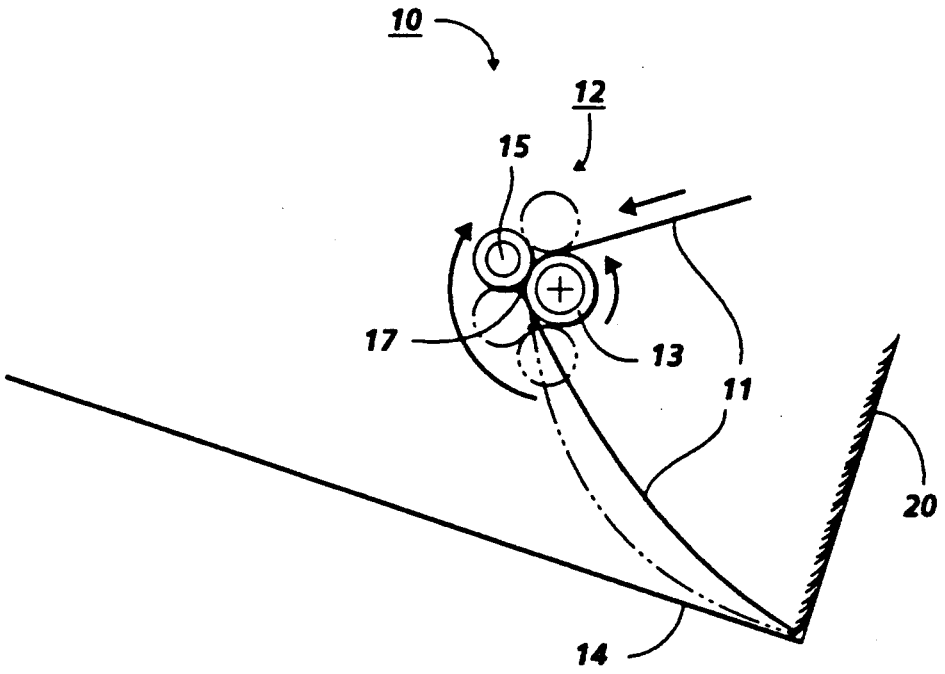
Figure 4:
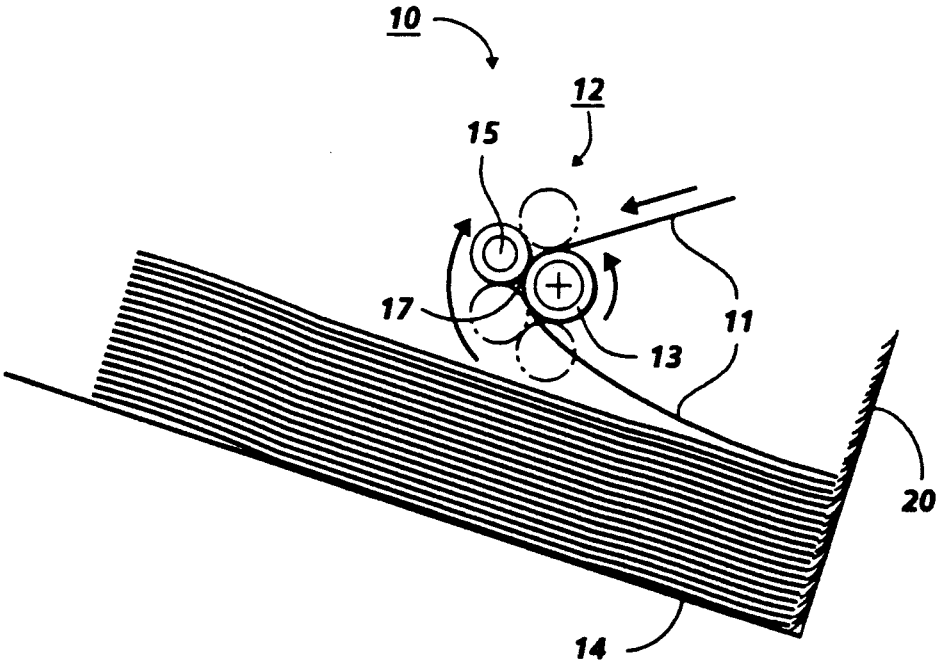

FIGS. 1–4 here illustrate a sheet stacking system 10 with an orbital nip system 12 with a fixed drive roller 13 and orbital idler roller 15, like those incorporated above. FIGS. 1–3 show the steps of feeding in the first sheet 11 to a simple fixed sheet stacking tray 14 which is empty. FIG. 4 shows the stacking of a subsequent sheet 11 after the tray 14 has already been filled with a substantial stack of prior sheets 11.

As in the above-cited systems, sheet inversion is provided by the simultaneous rotating and sheet feeding nip 17 of the opposing first and second sheet feeding rollers 13 and 15. The nip 17 engages the leading edge of a sheet 11 delivered to the nip 17. The axial rotation of the rollers 13 about their fixed central axis feeds the sheet partially through this nip 17. The nip orbital drive provides orbital motion of the rollers 15 about the axis of stationary rollers 13, so that the rollers 15 stay in contact with rollers 13, to progressively pivot the nip 17, and thereby change the angular direction of motion of the sheet while the sheet is feeding in or through the nip. Only a small area of the sheet (virtually a line contact) is pressed in the nip 17 against rollers 13 by rollers 15 at any particular moment, and thus all the adjacent portions of the sheet 11 can assume a larger radius than rollers 13. The initial pivotal angle position of the nip 17 is preferably substantially the same for the initial engaging of the leading edge of each sheet being delivered to the nip. That initial nip angle, may be, for example, substantially horizontal, as shown in FIG. 1.

The tray 14 here may conventionally provide, as shown, a generally horizontal stacking surface but with a downwardly sloping inclination toward an registration stacking wall 20, which is perpendicular thereto, and defines a stacking corner therewith.

The following description is broken into steps, for clarity, although it will be appreciated that the various movements may continuously follow one another or even slightly overlap.

In the first step, the orbiting nip unit 12 may begin here a counterclockwise orbit motion of rollers 15 as soon as the lead edge of the sheet 11 is acquired by the nip 17. This action escorts within the moving nip 17 the sheet's lead edge around the outside diameter of driver rollers 13 until the nip reaches the approximate angle shown in FIG. 1, at which angle the lead edge of the sheet 11 is aimed at near the top of the desired maximum stack height, well up on the registration stacking wall 20. In this example, this angle is in an essentially horizontal rightward direction. Note that this is done even if the tray 14 is empty, as shown in FIG. 1. [This initial orbital nip movement also effectively turns the sheet 11 over and reverses its direction of sheet motion, for sheet inversion and inverted stacking here.] This initial nip orbiting may be at a constant velocity approximately equal to the rollers 13 surface velocity, i.e., at approximately the same angular velocity, or less. This initial counterclockwise nip orbiting action stops with the rollers 15 at the position of FIG. 1 shown by the arrowhead and the final phantom line position of roller 15.

In the next step, the rollers 13 then continue to drive the sheet 11 slightly further until the sheet's lead edge is about 10 mm from the registration backstop or end wall 20. That is, within a spacing or distance range of about 5–25 mm between the sheet lead edge and wall 20. That is illustrated by the imaginary dashed line parallel wall 20 in FIG. 1.

In the third step, as shown in FIG. 2, the nip 17 begins to reverse orbit (orbiting clockwise here) at approximately one-half (0.4–0.6) of the continued forward feeding velocity of the feed rollers 13. That is, the nip orbiting reversal is started early, before the sheet lead edge reaches the registration wall 20, but slowly. This is even though the lead edge of sheet 11 usually drops down in the catch tray 14, as shown, and thus is initially even further away from wall 20. However, the sheet continues to be fed further forward by rollers 13, so that the sheet lead edge will feed on until the sheet's lead edge reaches the registration wall 20. As shown in FIG. 3, even though the sheet lead edge may initially miss the registration corner between an empty [or low stack] tray 14 and registration wall 20, it is driven into that corner by the fact that the forward drive of the sheet towards wall 20 by rollers 13 is faster than the reverse movement of the nip 17 away from the wall 20 here.

Once the sheet 11 lead edge reaches the registration wall 20, this continued forward drive by rollers 13 causes the portion of the sheet 11 downstream of the nip 17 to buckle out, holding the lead edge pressed against the wall 20, as shown in FIG. 3 in phantom line. The amount of sheet 11 buckle will vary with the stack height in the tray 14.

By starting the nip reverse orbiting early, as indicated above, before the sheet lead edge reaches the backstop wall 20, the nip is already downwardly pivoted away from the wall 20, at an angle beyond the line from the nip to the registration corner before the sheet reaches the wall 20, thus imparting with the nip 17 a consistently downwardly (never upwardly) bending or buckle forming deflection of the extending downstream portion of the sheet. The sheet is not ever pulled away from wall 20 by the movement of the nip away from wall 20, because this reverse orbiting motion is sufficiently slow not to do so. Thus, as indicated, there is a definable operable or optimized range or ratio of nip rotation to nip feeding velocity. As noted above, this has been determined to be approximately 0.4 to 0.6. If there are already a large number of sheets stacked in the tray 14, as shown in FIG. 4, this controlled buckle simply automatically increases to accommodate that consequent difference in the registration wall 20 lead edge impact position.

Once sufficient time has been provided so that the lead edge of the sheet 11 will have contacted the backstop or registration edge 20 of even an empty tray 14 and buckled, (a simple function of the distance of the registration corner from the nip and the nip feeding velocity), the orbital unit 12 may either continue to be reverse orbited in the same manner, or, preferably, a different orbital speed profile may be used (depending on the particular tray geometrics) that enables the remaining, trailing edge portion of that same sheet to be driven faster and/or in a continuously changing nip angle to properly roll or unscroll onto the tray 14 stack, as illustrated in FIG. 4.

The nip 17 may then continue to be thus reversed back to its home or original sheet entrance position, where this reverse orbital motion is stopped, and any remainder of sheet 11 may then fed out of the nip 17 in an essentially horizontal leftward direction. When the trailing edge of the sheet passes through the nip 17, this released sheet end flips out over the outer end of the stack into the outer end area of stacking tray 14. At this point, sheet inversion and stacking into the stacker or compiler is completed. The orbiting nip system is back in the proper position to receive the next sheet. This orbiting, return orbiting, and orbit stopping sequence is repeated for each sheet of the set to be stacked.

This downwardly flexing and rolling on of the sheet onto the top of the stack (rather than dropping or sliding) provides positive sheet stacking control and avoids air being trapped under the sheet which would resist settling and could contribute to incoming sheet misregistration relative to the stack. Also, as noted, this system prevents pulling of the sheets 11 away from their registration wall 20. This is in contrast to conventional sheet stackers using a conventional fixed, and usually uphill aimed, output nip. There, the sheet simply drops, and then free floats, down onto the stack in an uncontrolled fashion, and depends on gravity to slide back into stack alignment, thus contributing to slow and uneven settling and scatter in the stack, and reducing stack capacity with curled sheets.

For duplexing or same side or highlight color printing, or any other non-inverting stacking system, the same basic system may be utilized with a somewhat different orbiting nip operation. In this case, the nip 17 is not substantially rotated from its normal or initial position until after the sheet feeds almost through the nip 17, so that the trail edge area of the sheet is in the nip 29. Then the orbital nip unit may be rotated slightly clockwise to orbit the trail end of the sheet to aim it toward wall 20, high up thereon, as in the nip orientation of FIG. 1. Then (or just before reverse orbiting starts), the driven rollers 13 are reversed, so that the sheet is driven back towards wall 20, just as described above. The remaining steps may also be just as described above. I.e., clockwise nip orbiting at a rate 0.4 to 0.6 of the roller 13 feeding speed as as [what was previously the trail] edge of the sheet is fed to within approximately 10 mm of the wall 20. In this case however, the end result is that the sheets are stacked without having been inverted. This option can provide selectable 1-N or N-1 faceup or facedown stacking, without adding separate actuating mechanisms for gates or other such devices to the paper output path.

An integral or related copy set stapler or other finisher can be provided for the tray 14, functioning as a compiler, as disclosed, for example, in U.S. Pat. No. 5,098,074, issued Mar. 24, 1992 by Barry P. Mandel, et al., or other finishing or other operations performable on either single sheets or sets.

It will be appreciated that the sheet entrance and stacking positions, and their relative orientations, are exemplary, and will depend on the particular desired features and overall unit design, as previously noted. However, it is desirable, as is illustrated, that the path entrances and tray stacking registration positions be located relatively closely adjacent to the nip 17, so as to relatively minimize the unsupported or cantilevered path length of the sheet after the sheet is fed out of the nip 17, and to accommodate short sheets. This also provides for a more compact overall output station 10. Providing, however, that here a sufficient extended sheet distance downstream of the nip is provided for the above-described variable buckle to form. E.g., approximately 2 centimeters, minimum.

Note that this present system does not require any elevator mechanisms or moving floors for the stack of sheets to accommodate the increase in stack height as the tray fills. Thus, the stacking tray 14, or other stacking tray, can be a simple fixed bin or tray. In fixed tray stacking, the distance from the nip to the sheet backstop impact position for the lead edge of the incoming sheet will, of course, vary with the stack height, which leads to problems with upward bucking or stacking registration. The present system overcomes these problems expected with such fixed stacking trays.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a method of sheet stacking utilizing an orbital nip system in which opposing first and second sheet feeding rollers form a sheet transporting nip for engaging a sheet delivered to said nip and for feeding the sheet in the nip with a nip sheet feeding velocity into a stacking tray and against a registration stacking wall extending generally perpendicular to the stacking tray, and also providing relative orbital motion of said opposing rollers for pivoting the sheet feeding angle of said nip, at a selectable orbiting angular velocity; the improvement comprising the steps of:

orbiting the nip with the sheet in the nip into an initial sheet input position for which the nip sheet feeding angle is aimed well up on the registration stacking wall above the stacking tray and adjacent the desired maximum stack height;

feeding the sheet with the nip in said initial sheet input nip position out towards the registration stacking wall at a preset nip feeding velocity without substantially orbiting said nip;

then, when the sheet is fed out closely adjacent to, but not yet touching the registration stacking wall, orbiting the nip with the sheet in the nip downwardly and away from the registration stacking wall at an orbiting velocity which is substantially slower than said preset nip feeding velocity, such that the movement of the sheet towards the registration stacking wall by said nip feeding is substantially faster than said orbital motion of the nip away from the registration stacking wall, so as to feed the sheet against the registration stacking wall and cause the portion of the sheet downstream of the nip to downwardly buckle and hold the sheet edge against the registration stacking wall as the remainder of the sheet is fed through the nip.

2. The method of sheet stacking of claim 1, wherein said nip orbiting away from the registration stacking wall is started when the edge of the sheet is within approximately 10 millimeters of the registration stacking wall.

3. The method of sheet stacking of claim 1, wherein said nip orbiting velocity away from the registration stacking wall is at approximately one-half of the continued nip sheet feeding velocity.

4. The method of sheet stacking of claim 1, wherein said nip orbiting velocity away from the registration stacking wall is between approximately 0.4 and 0.6 of the continued feeding velocity of the sheet in the nip towards the registration stacking wall.

5. The method of sheet stacking of claim 1, wherein said nip orbiting angular velocity away from the registration stacking wall is such that, irrespective of the stack height in the stacking tray, before the sheet edge reaches the registration stacking wall the nip is already at a sufficient angle to impart a downwardly buckle forming deflection of the extending portion of the sheet.

* * * * *